US005290523A

United States Patent [19]

Koppelman

[11] Patent Number: 5,290,523

[45] Date of Patent: Mar. 1, 1994

[54] METHOD AND APPARATUS FOR UPGRADING CARBONACEOUS FUEL

[76] Inventor: Edward Koppelman, 4424 Gergamo Dr., Encino, Calif. 91316

[21] Appl. No.: 952,330

[22] Filed: Sep. 28, 1992

Related U.S. Application Data

[63] Continuation-in-part of Ser. No. 850,562, Mar. 13, 1992, abandoned.

[51] Int. Cl.[5] ..... F28D 7/16

[52] U.S. Cl. ..... 422/201; 165/1; 422/198; 422/202

[58] Field of Search ..... 44/591, 592, 593, 600, 44/607, 608, 620; 34/9, 10, 14, 177, 165, 169, 167; 422/198, 200, 201, 202; 165/1

[56] References Cited

U.S. PATENT DOCUMENTS

| | | | |
|---|---|---|---|
| 2,897,054 | 12/1954 | Miley . | |
| 3,520,067 | 10/1968 | Winegartner . | |
| 4,052,168 | 10/1977 | Koppelman | 44/1 |
| 4,089,656 | 5/1978 | Cole | 44/1 R |
| 4,098,656 | 6/1978 | Cole | 44/608 |
| 4,285,140 | 8/1981 | van Raam et al. | 34/15 |
| 4,505,211 | 3/1985 | Lamare | 34/10 |
| 4,523,927 | 6/1985 | Kuge et al. | 44/1 B |
| 4,601,113 | 7/1986 | Draper et al. | 34/10 |
| 4,626,258 | 12/1986 | Koppelman | 44/2 |

*Primary Examiner*—Robert J. Warden
*Assistant Examiner*—Amalia Santiago
*Attorney, Agent, or Firm*—Harness, Dickey & Pierce

[57] ABSTRACT

The present invention is concerned with upgrading the BTU values of carbonaceous materials. The carbonaceous material is introduced into a heat exchanger and is injected with gas such as an inert gas or carbon dioxide at a high pressure to raise the pressure at which the upgrading process is carried out. The carbonaceous material is then heated to the desired temperature by circulating a heat exchange medium throughout at least one vessel which is in contact with the carbonaceous material. Water and other by-products such as tar and gases are recovered during this process. The heated water may be used as a source of pre-heating feed material in another vessel.

56 Claims, 5 Drawing Sheets

METHOD AND APPARATUS FOR UPGRADING CARBONACEOUS FUEL

CROSS REFERENCE TO RELATED APPLICATIONS

This application is a continuation-in-part of U.S. application Ser. No. 850,562 filed Mar. 13, 1992 now abandoned.

BACKGROUND OF THE INVENTION

The present invention is particularly applicable, but not necessarily restricted to methods of processing carbonaceous materials under high pressures to increase the BTU value of the carbonaceous material. Typical of the methods to which the present invention is applicable is the treating of various naturally occurring carbonaceous materials, such as wood, peat or sub-bituminous coal, to render them more suitable as solid fuel.

A number of inventions relating to upgrading carbonaceous fuel have heretofore been used or proposed so as to render the carbonaceous fuel more suitable as a solid fuel. Many problems such as extensive costs, both in manufacturing and operating carbonaceous fuel upgrading systems, difficult and complex controls for enabling the operation of carbonaceous fuel upgrading systems on a continuous basis, and a general lack of flexibility and versatility of such equipment for adaptation for the processing of other materials at different temperatures and/or pressures are common.

The methods and apparatuses of the present invention overcome many of the problems and disadvantages associated with prior art equipment and techniques by providing units which are of simple design, durable construction, versatile in use and readily adaptable for processing different feed materials under varying temperatures and/or pressures. The apparatuses of the present invention are further characterized as being simple to control and efficient in the utilization of heat energy, thereby providing for economical operation and a conservation of resources.

SUMMARY OF THE INVENTION

The benefits and advantages of the present invention are achieved by the following methods and apparatuses in which carbonaceous materials are charged into a heat exchanging apparatus comprising at least one internal tube surrounded by an outer casing under atmospheric conditions. After the carbonaceous material is changed into the heat exchanging apparatus, the carbonaceous material is injected with a pressurized gas. In one embodiment of the present invention, a heat exchange medium having a temperature of between approximately 250° F. to about 1200° F. and generally about 750° F. is circulated throughout the casing such that the heat exchange medium is in contact with the outer periphery of the internal tube(s). The heat exchange medium enters the casing through a first valve located proximate to the top of the heat exchanger and exits the casing through a second valve located proximate to the bottom of the heat exchanger. The temperature remains elevated for a controlled period of time to effect an increase in the BTU value of the carbonaceous material. Water and other by-products, such as tar and gases, which have been driven from the carbonaceous material are recovered through a valve located at the bottom of the heat exchanger. At the conclusion of the heat exchange step, the carbonaceous material is transferred to one or more containment vessels where the carbonaceous material is stored until it can be transferred to an extruder for pelletizing.

In a second embodiment, carbonaceous material is charged into a heat exchanger having at least one internal tube which is surrounded by an outer casing. The outer casing is provided with four inlet/outlet valves through which the heat exchange medium enters and exits the casing. The first valve is located proximate to the top of the heat exchanger, the second valve is positioned below the first valve approximately one-third the length of the heat exchanger, the third valve is positioned below the second valve approximately two-thirds the length of the heat exchanger and the fourth valve is located below the third valve proximate to the bottom of the heat exchanger. In this embodiment, the heat exchange medium is introduced through the first valve and is circulated down the heat exchanger within the outer casing until the heat exchange medium reaches the second valve which is opened to allow the heat exchange medium to be circulated back through a furnace where it is reheated. Once the heat exchange medium has been reheated, it is recirculated back through the first valve. After substantially all of the water has been driven down below the level of the second valve, the second valve is closed and the third valve is opened causing the water to vaporize and condense on the coal contained below the level of the second valve. This process of opening and closing valves is continued until substantially all of the water has been driven down to the bottom of the heat exchanger where it is collected and drained off. Again, it is contemplated that the heat exchange medium will have a temperature of between about 250° F. to about 1200° F. and a system pressure of between about 2 PSIG to about 3000 PSIG.

A third embodiment of the present invention comprises an outer casing into which the carbonaceous material is charged for upgrading. The outer casing includes a plurality of horizontally aligned tubes located within the casing which contain the heat exchange medium. The heat exchange medium is circulated downward in succession throughout the horizontally aligned tubes while an inert gas is injected into the casing. The temperature of the heat exchange medium will be between about 250° F. to about 1200° F. and the pressure will be between about 2 PSIG and 3000 PSIG.

A fourth embodiment of the present invention comprises an outer casing into which carbonaceous material is charged for upgrading, and a plurality of vertically aligned tubes extending down into the casing. A heat exchange medium is circulated throughout the vertically aligned tubes and inert gas is injected into the outer casing to facilitate upgrading of the carbonaceous material. Hereto, the temperature of the heat exchange medium will be between about 250° F. and 1200° F. and the system pressure will be between about 2 PSIG to about 3000 PSIG.

BRIEF DESCRIPTION OF THE DRAWINGS

Additional benefits and advantages of the present invention will become apparent from a reading of the description of the preferred embodiments taken in conjunction with the specific examples provided and the drawings, in which.

DETAILED DESCRIPTION

The present invention is applicable for upgrading carbonaceous materials, including, but not limited to, ground coal, lignite and sub-bituminous coals of the type broadly ranging between wood, peat and bituminous coals which are found in the deposits similar to higher grade coals. Carbonaceous materials as mined generally contain from about 20% up to about 80% moisture and can often be directly employed without any preliminary treatment other than granulating the carbonaceous material to the desired size. The particle size of the carbonaceous material in large part determines the time necessary to upgrade the carbonaceous material to the desired level. In general, the larger the particle the more time it takes to upgrade the carbonaceous fuel.

Figure 1:
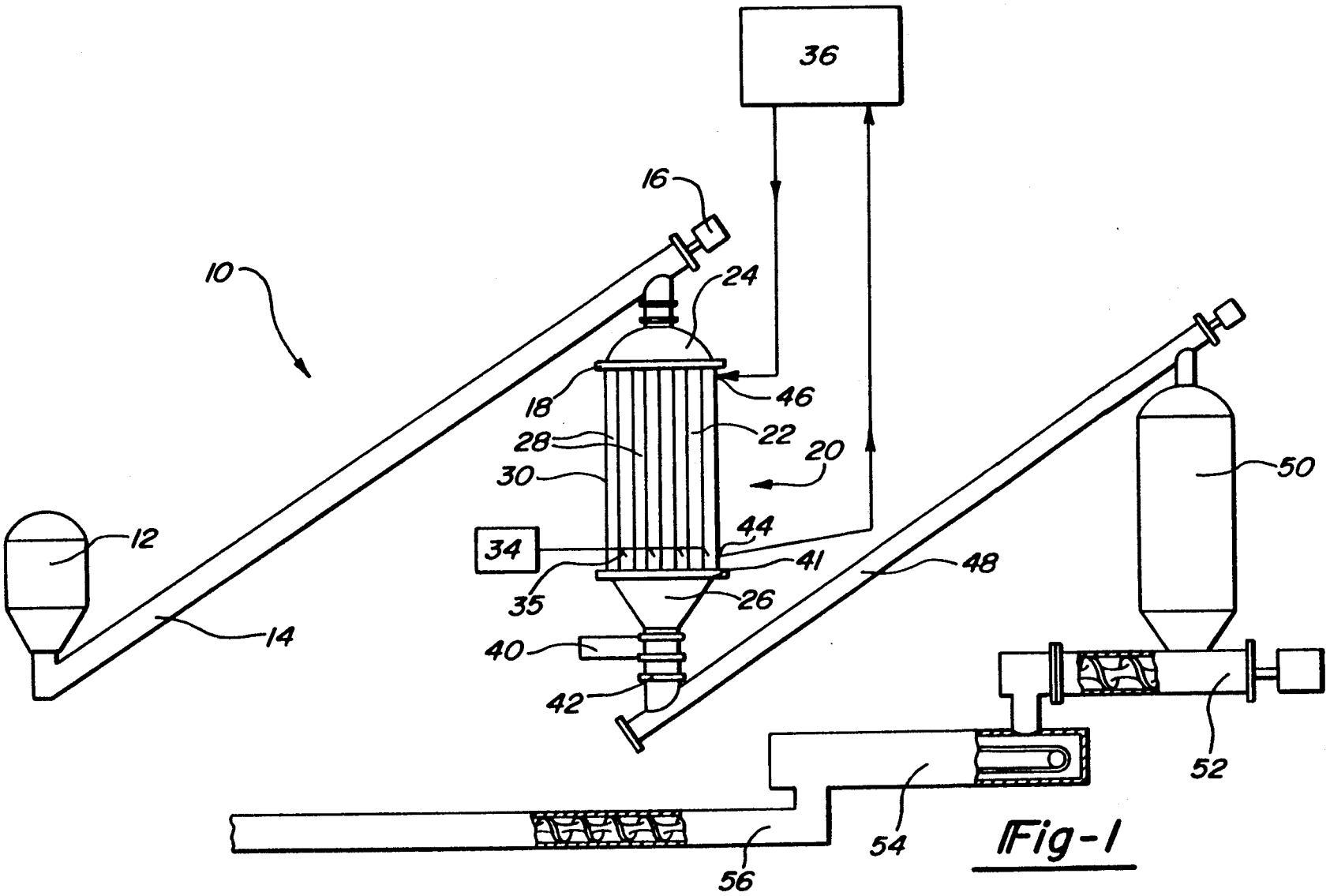
FIG. 1 is a functional schematic view of a batch type heat exchanger-based fuel upgrading system arranged in accordance with the principles of the present invention.

With reference to FIG. 1, a batch type fuel upgrading system 10 is disclosed as having a heat exchanger 20 which comprises a chamber having an inlet 24 at one end and an outlet 26 at the other end, a plurality of tubes 28 extending the length of the chamber and an outer casing 30 which surrounds the plurality of tubes 28. Carbonaceous material is transported from a bin 12 via conveyor 14 to the inlet end 24 of the heat exchanger 20. Valves 16 and 18 located at the top of the heat exchanger are opened to allow the carbonaceous material to be charged within tubes 28. A valve 41 provided near the bottom of the heat exchanger 20 is closed prior to filling the tubes 28 with carbonaceous material. After the tubes 28 have been filled, the valves 16 and 18 are closed to contain the carbonaceous material within the tubes 28. An inert gas 34, such as nitrogen or another gas such as carbon dioxide, is then injected through valves 35 into the tubes 28 to fill the spaces between the carbonaceous particles and raise the pressure within the tubes. The nitrogen or other inert gas is under pressure such that when the flow is activated the gas readily flows into tubes 28 which are at atmospheric pressure. When the pressure within the tubes is raised to the desired level, the flow of gas is turned off.

A heat exchange medium, such as heated gas, molten salt or preferably an oil, having a temperature of between about 250° F. and 1200° F. and preferably about 750° F. is continuously circulated throughout the casing 30 by entering the casing through valve 46 and exiting valve 44. The heat exchange medium which exits valve 44 is passed through a furnace 36 which reheats it prior to reintroduction of the medium into casing 30. The inner wall of the casing 30 is provided with a plurality of successive open-ended inwardly extending flanges 22 over which the heat exchange medium flows in a step-like manner downward through casing 30. The inert gas or carbon dioxide gas acts as a heat transfer carrier by coming into contact with the inner wall of the tubes 28, absorbing heat and driving the heat into the carbonaceous material.

In the event that the carbonaceous material contained within the tubes 28 has a sulfur content above a desired level, hydrogen can be injected into the tubes 28 along with the inert gas or carbon dioxide gas to drive excessive sulfur out of the carbonaceous material. Generally, the amount of hydrogen needed is directly proportional to the percentage of sulfur to be removed.

Moisture contained in the carbonaceous material is driven downward within the tubes 28 as a result of the downward flow of the hot heat exchange medium around the tubes. At a sufficiently high temperature, the moisture contained in the carbonaceous material vaporizes and condenses on the cooler carbonaceous material located toward the bottom of the tubes 28. Eventually, substantially all of the water, along with other by-products such as tar and gases, is collected at the outlet 26 of the heat exchanger 20. A valve 40 located at the bottom of the heat exchanger 20 can be opened to drain the water and other by-products from the heat exchanger.

The amount of time the carbonaceous material must remain within the tubes 28 will vary depending upon the size of the granules, the temperature at which the system is operated, the pressure of the gas injected into the tubes and the heating value that is desired. Typically, the amount of time ranges from about 5 minutes to about 30 minutes. The amount of time required generally decreases as the temperature and pressure in the heat exchanger increase. Conversely, the amount of time required increases when lower temperatures and pressures are used.

The process utilizing system 10 can be carried out at temperatures ranging from approximately 250° F. to 1200° F. and at pressures ranging from approximately 2 to about 3000 PSIG. The most consistent results for upgrading the carbonaceous material tend to occur when the temperature at which the heat exchange medium circulates throughout the system is allowed to reach on the order of about 750° F.

At the conclusion of the heat exchanging and upgrading step, the pressure is released by opening the control valve 41. The tubes 28 located within the outer casing 30 are emptied by opening valve 41 and then valve 42 located at the bottom of the heat exchanger. The carbonaceous material is then transferred upon a conveyor 48 to a second bin 50 where it is temporarily stored. Extending from the bottom of the second bin 50 is an extruder 52 which pelletizes the carbonaceous material and transfers it to a cooler 54. After the carbonaceous material has cooled sufficiently, the material is transferred to a second extruder 56 which transfers the pellets to a storage site.

Figure 2:
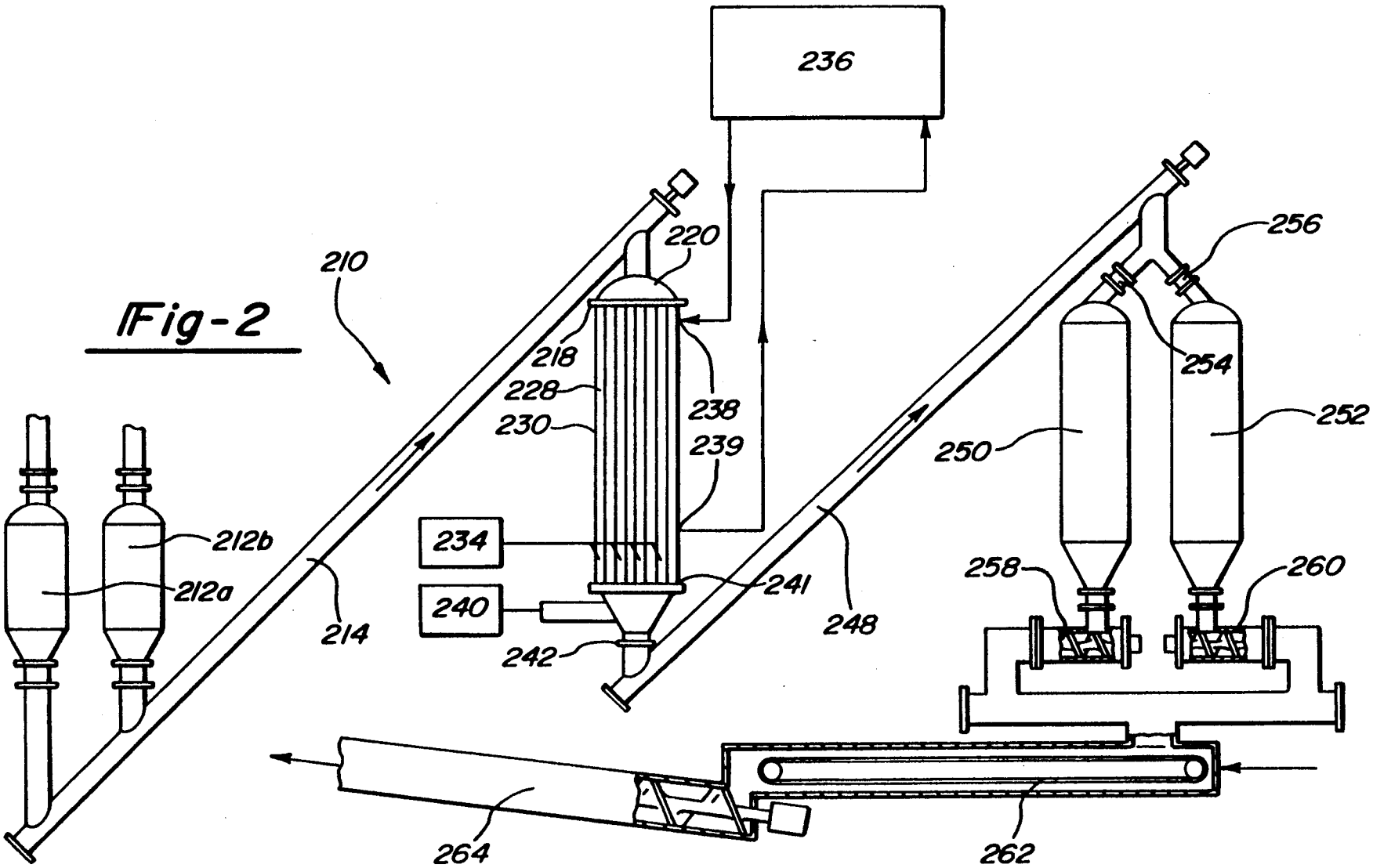
FIG. 2 is a functional schematic view of a continuous type heat exchanger-based fuel upgrading system arranged in accordance with the principles of the present invention.

With reference to FIG. 2, a continuous type fuel upgrading system 210 is shown. The continuous fuel upgrading system includes a pair of containment bins 212*a* and 212*b*, otherwise referred to herein as lock hoppers which store the carbonaceous material to be upgraded. The carbonaceous material is deposited on a conveyor 214 which leads to the top of the heat exchanger 220. Bottom valve 241 is closed, then the carbonaceous material is passed through a valve 218 provided at the top of the heat exchanger and into tubes 228 contained within outer casing 230. The process is rendered continuous, since one of the lock hopper 212*a* or 212*b* can be refilled while the other one is being emptied via conveyor 214.

Once the tubes 228 are full, the valve 218 is closed and an inert gas such as nitrogen or another gas such as carbon dioxide is injected into the tubes 228 under pressure. The inert gas 234 or other gas such as carbon dioxide is under pressure such that when the flow is activated the gas readily flows into tubes 228 which are at atmospheric pressure. When the pressure within the tubes is raised to the desired level, the gas flow is turned off. The inert gas or other gas such as carbon dioxide raises the pressure of the system to between about 2 PSIG to about 3000 PSIG, and preferably will raise the pressure of the system to about 800 PSIG. After the tubes have been pressurized, the temperature of the carbonaceous material is raised by continuously circulating a heat exchange medium throughout the casing 230 as described with reference to heat exchanger 20 in FIG. 1. Again, because of the downward flow of the heat exchange medium, substantially all of the moisture contained in the carbonaceous material is driven to the bottom of the heat exchanger 220, where it can be collected and drained off through valve 240 along with any by-products such as tar or other gases, which are driven off. The heat exchange medium exits the casing 230 via valve 239 and is circulated through a furnace 236 prior to being reintroduced through valve 238. It is contemplated that the temperature of the heat exchange medium will be between about 250° F. to about 1200° F. and preferably will be about 750° F.

The nitrogen 234 or other inert gas serves as a heat transfer carrier by contacting the inner wall of the tubes 228, picking off the heat and transferring it into the carbonaceous material. Once the heat exchanging and upgrading process is completed, valves 241 and 242 are opened at the bottom of the heat exchanger 220 allowing the pressure to be reduced to atmospheric pressure and the carbonaceous material to drop onto a conveyor 248 which transfers the material to a pair of output lock hoppers 250 and 252. A valve 254 is opened on the first lock hopper 250 allowing the carbonaceous material to be deposited therein. Once the first hopper 250 is full, the valve 254 is closed and the valve 256 positioned on the top of the second lock hopper 252 is opened so that the carbonaceous material can flow into it. Both lock hoppers 250 and 252 are provided with extruders 258 and 260, respectively, pelletize the carbonaceous material and which transfers it to a cooler 262. After sufficient cooling, the carbonaceous material is transferred to a second extruder 264 which transports the carbonaceous material to a storage facility.

Figure 3:
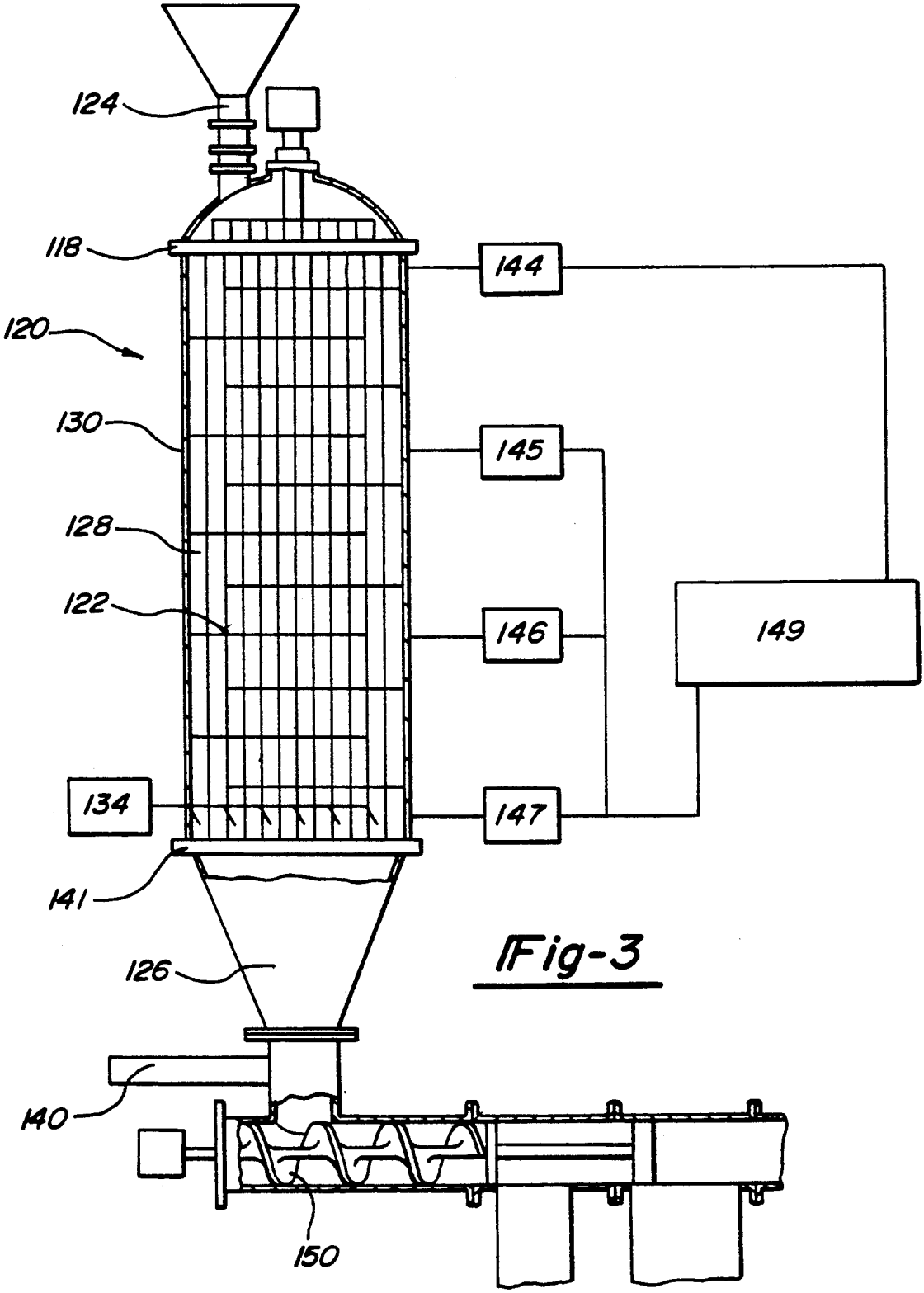
FIG. 3 is a side elevation view of a second heat exchanger embodiment having a plurality of inlet/outlet valves arranged in accordance with the principles of the present invention.

FIG. 3 shows a second embodiment of a heat exchanger 120, which can be used with the batch type system of FIG. 1 in accordance with the present invention. In this embodiment, the heat exchanger 120 includes an inlet 124 and outlet 126 for the carbonaceous material located at opposing ends of exchanger 120, a plurality of tubes 128 into which the carbonaceous material is charged for upgrading, an upper valve 118 and a lower valve 141 to maintain the carbonaceous material under pressure within the tubes 128, and an outer casing 130 which surrounds the plurality of tubes and inlet valves 135 for injecting an inert gas 134 or another gas such as carbon dioxide into the tubes. The inert gas or carbon dioxide gas is under pressure such that when the flow is activated the gas readily flows into tubes 128 which are at atmospheric pressure. When the pressure within the tubes is raised to the desired level, the gas flow is turned off. Generally, the inert gas will raise the pressure of the system to between about 2 PSIG and 3000 PSIG and preferably to about 800 PSIG. The outer casing 130 includes four inlet/outlet valves 144–147 through which heat exchange medium is circulated. The first valve 144 is located proximate to the top of the heat exchanger just below the valve 118. The second valve 145 is located down about one-third the length of the heat exchanger 120 below the first valve 144. The third valve 146 is located down about two-thirds the length of the heat exchanger 120 below both the first and second valves and the fourth valve 147 is located proximate to the bottom of the heat exchanger 120 above valve 141. Extending from the inner wall of the casing 130 are a number of open-ended flanges 122 arranged in an alternating step-wise fashion over which the heat exchange medium flows downwardly within casing 130.

After valve 141 has been closed, the carbonaceous material has been charged into the tubes 128 and the valve 118 has been closed and the inert gas or carbon dioxide has been injected into the tubes 128, a heat exchange medium is continuously circulated throughout the casing 130 to increase the temperature of the carbonaceous material contained within the tubes 128. The heat exchange medium which has been heated by a furnace 149 to a temperature sufficient to vaporize the moisture contained within the carbonaceous material. Typically the heat exchange medium is heated to between about 250° F. and about 1200° F. and is preferably heated to about 750° F. The heat exchange medium is introduced into casing 130 through the first valve 144. With valves 144 and 147 open and valves 145 and 146 closed initially, heat exchange medium is allowed to fill the casing 130. Once the casing is filled, valve 147 is closed and valve 145 is opened so that the heat exchange medium circulates mainly through the upper one third of the casing. As the heat exchange medium flows to the end of the uppermost flange 122, the heat exchange medium flows down to the next flange 122. This back and forth downward flow continues until the heat exchange medium reaches the second valve 145 where it flows out through the second valve 145 and is circulated back through the furnace 149 for reheating. During the process of circulating a heat exchange medium throughout the casing 130, moisture which is contained in the carbonaceous material vaporizes and condenses on the cooler carbonaceous material located below the level of the heat exchanger where the heat exchange medium is being circulated. After substantially all of the moisture contained in the carbonaceous material located in the top one-third of the tubes 128 has been driven down below the level of the second valve 145, the second valve 145 is closed and the third valve 146 is opened while the fourth valve 147 remains closed. This now allows the heat exchange medium to circulate throughout the top two-thirds of the casing until essentially all of the moisture vaporizes and condenses on the carbonaceous material located below the level of the third valve 146. When substantially all the moisture is contained below the level of the third valve 146, the third valve 146 is closed while the second valve 145 remains closed and the fourth valve 147 is opened. Eventually, substantially all of the moisture which was present in the charge of carbonaceous material is driven below the level of the fourth valve 147 where it is collected and drained from the heat exchanger through valve 140 along with other by-products, such as tar and other gases, which come-off the charge. After the upgrading process is complete, the charge is fed to extruder 150 for pelletizing.

Figure 4:
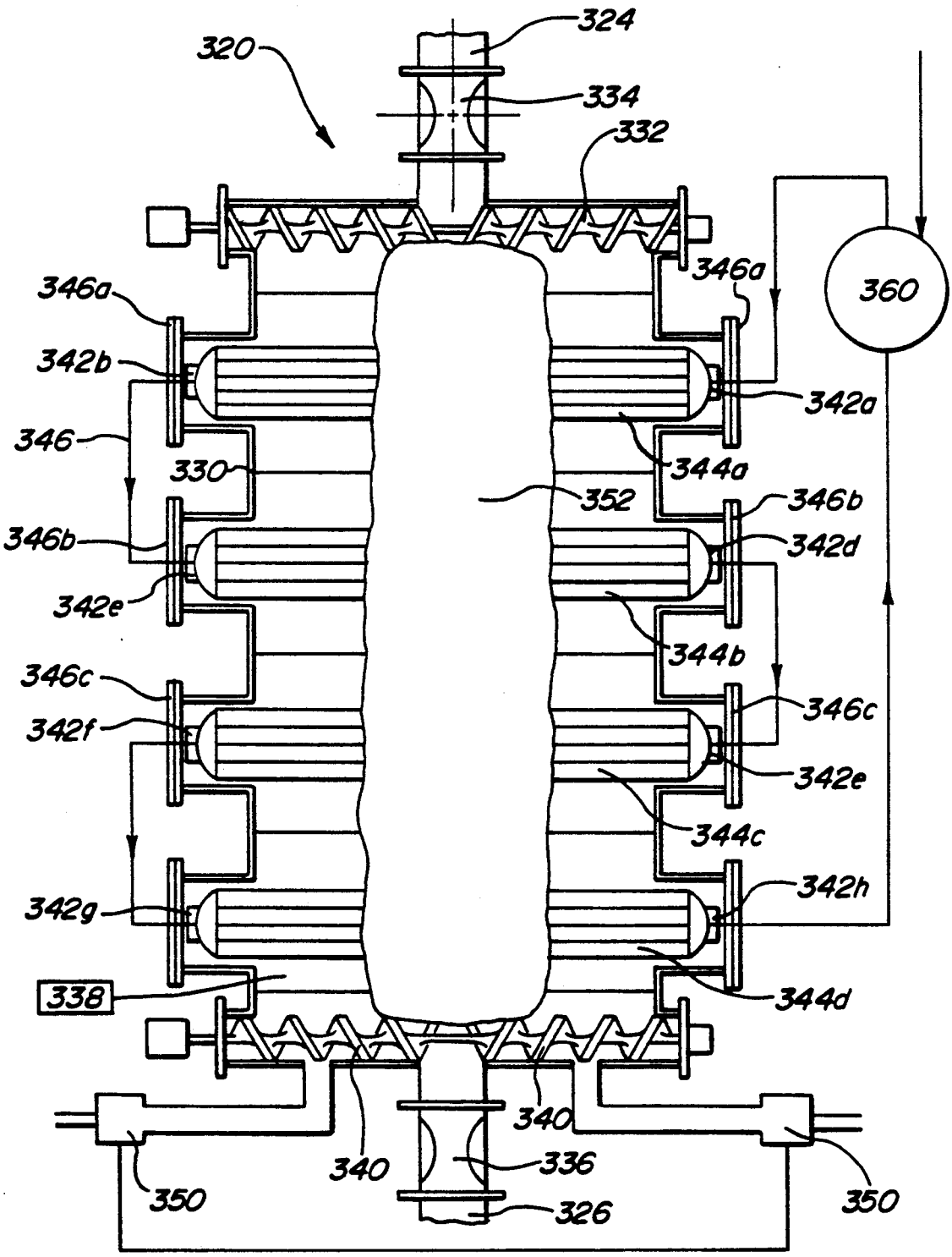
FIG. 4 is a side elevation view of a third heat exchanger embodiment having an outer casing which holds the carbonaceous material and a plurality of horizontally aligned tubes contained within the outer casing through which heat exchange medium is circulated in accordance with the principles of the present invention.

FIG. 4 shows a third embodiment of a heat exchanger 320 which preferably is used with the batch type system of FIG. 1 in accordance with the present invention. In this embodiment, the heat exchanger 320 includes an inlet 324 and an outlet 326 located at opposite ends of the heat exchanger, a plurality of horizontally aligned tubes 344(*a–d*) through which heat exchange medium is circulated to heat the carbonaceous material and an outer casing into which the carbonaceous material is charged. The carbonaceous material is dropped onto one of two axially aligned augers 332 which rotate outwardly to distribute the carbonaceous material throughout the casing 330. Valve 336 is closed prior to charging the carbonaceous material into the outer casing 330. Once the carbonaceous material has been charged into the outer casing 330, valve 334 is also closed and an inert gas such as nitrogen 338 or some other gas such as carbon dioxide is injected into the casing 330. The inert gas is under pressure such that when the flow is activated the gas readily flows into casing 330 which are at atmospheric pressure. When the pressure within the tubes is raised to the desired level, the gas flow is turned off. It is desirable to raise the pressure of the system to between about 2 PSIG and about 3000 PSIG, with the preferred pressure being about 800 PSIG. The outer casing 330 includes a plurality of horizontally aligned tubes 344(*a–d*) having inlet/-outlet valves 342(*a–h*) through which heat exchange medium is circulated. Initially, the heat exchange medium enters the horizontally aligned tubes 344(*a*) through the first valve 342(*a*). The heat exchange medium travels through the first tube 344(*a*) until it reaches the trailing end of the first tube and passes through valve 342(*b*). At that point the heat exchange medium is transferred to a second horizontally aligned tube 344(*b*) via a coupling member 346. The heat exchange medium enters the tubes 344(*b*) through valve 342(*c*) whereby the direction of flow is opposite that of the first horizontally aligned tube 344(*a*). This method of circulating the heat exchange medium throughout the horizontally aligned tubes 344(*a–d*) and valves 342(*a–h*) continues until the heat exchange medium exits tubes 344(*d*). Once the heat exchange medium passes out of tube 344(*d*) through valve 342(*h*), the heat exchange medium is passed through a furnace 360 where it is reheated prior to being reintroduced through the first inlet valve 342(*a*). Generally it is necessary to heat the system to between about 250° F. and about 1200° F. and preferably to about 750° F. to vaporize the moisture contained within the carbonaceous material. Again, this method of circulating the heat exchange medium back and forth in a downward direction causes substantially all of the moisture contained within the carbonaceous material to be driven out of the charge, along with any other by-products such as tar and other gases, where it is collected off at valves 350 located at the bottom of the heat exchanger. After the upgrading process has been completed, a second pair of augers 340 transfer the upgraded carbonaceous material to the outlet 326. A blanket of insulation 352, shown partially cut away, is provided around the periphery of the casing to assist in maintaining the heat exchange medium at a relatively constant temperature. Also provided along the outer casing 330 are a plurality of hatches 346(*a–d*) which allow access to the tubes 344(*a–d*) whenever withdrawal of the tubes 344(*a–d*) is necessary.

Figure 5:
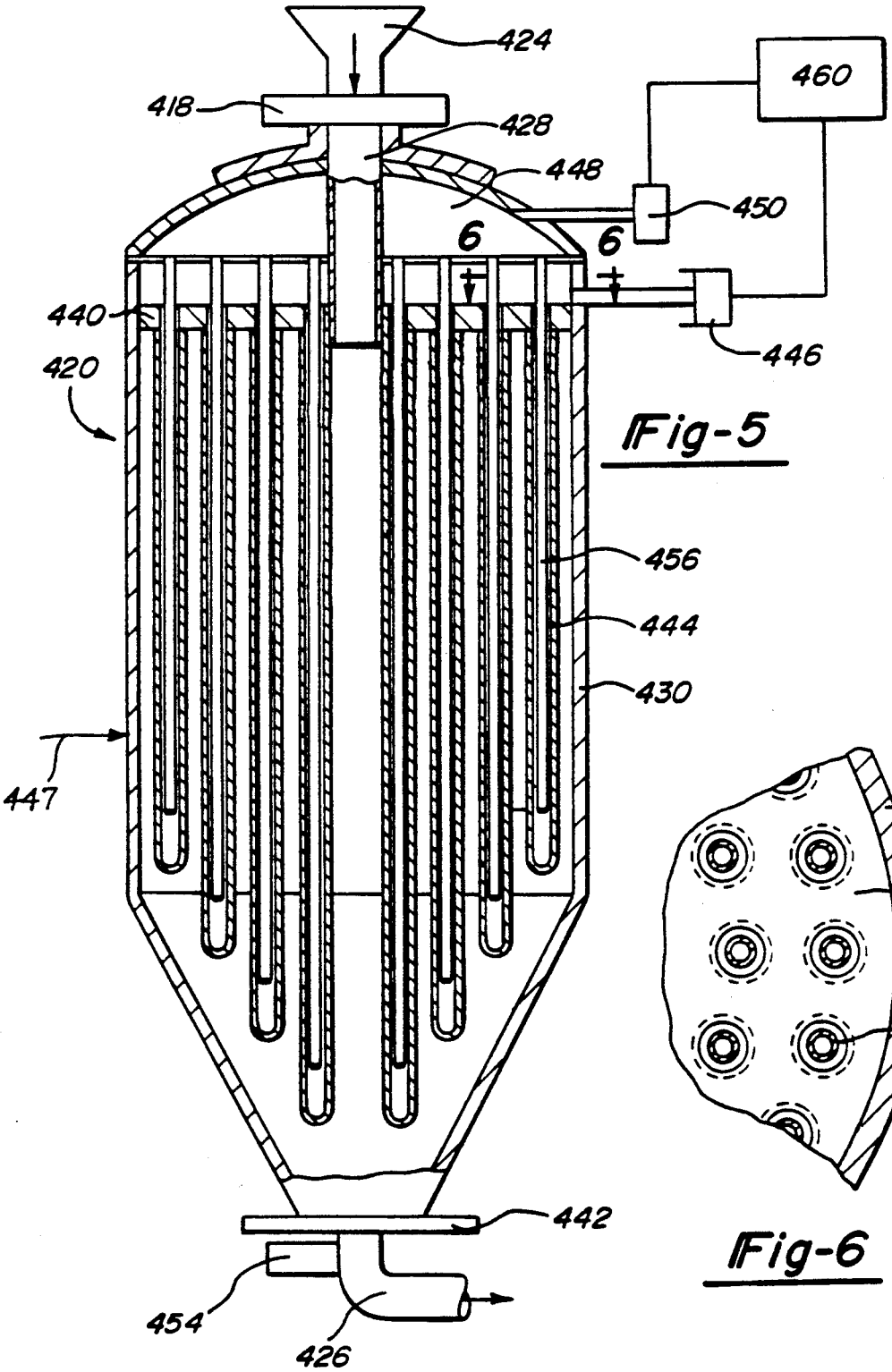
FIG. 5 is a side elevation view of a fourth heat exchanger embodiment having an outer casing which holds carbonaceous material and a plurality of vertically aligned tubes which extend into the outer casing through which heat exchange medium is circulated in accordance with the principles of the present invention.
Figure 6:
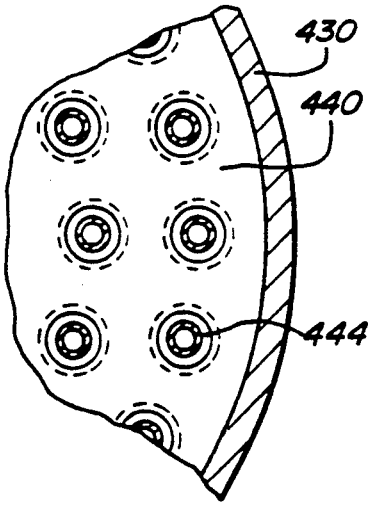
FIG. 6 is a cross-sectional view taken along lines 5—5 showing the tubes used to circulate a heat exchange medium.

FIGS. 5 and 6 demonstrate a fourth embodiment of a heat exchanger 420 useful with the present invention. In this embodiment, the heat exchanger includes an inlet 424 and an outlet 426 located at opposite ends of the heat exchanger, a tube 428 for directing the carbonaceous material down into the heat exchanger, a plurality of vertically aligned tubes 444 extending from a plate member 440 which separates the heat exchange medium from the carbonaceous material and an outer casing 430 into which the carbonaceous material is charged. To utilize the heat exchanger, valve 442 located proximate to the outlet 426 is closed and the carbonaceous material is deposited into the outer casing 430 through inlet 424, valve 418 and inlet tube 428. Valve 418 is then closed and an inert gas such as nitrogen or some other gas such as carbon dioxide is injected through an inlet 447 into the outer casing 430 to raise the pressure of the system. Typically, this inert gas will raise the pressure of the system to between about 2 PSIG and about 3000 PSIG and preferably to about 800 PSIG. When the pressure inside the outer casing reaches the desired level the gas flow is turned off.

Heat exchange medium is continuously circulated throughout the vertically aligned tubes 444 to raise the temperature of the carbonaceous material. To assist in the circulation, process shafts 456 extend into each of the vertically aligned tubes 444. As the heat exchanger medium contacts the shafts 456, the heat exchange medium tends to swirl within the tubes 444 due to the turbulent flow. The heat exchange medium enters the heat exchanger through valve 446, travels up and down through each of the vertically aligned tubes 444 into open area 448 and out valve 450 where it passes through a furnace 460, and reintroduced through valve 446. Ideally, the temperature of the heat exchange medium will be between about 250° F. and about 1200° and preferably will be about 750° F. The moisture and other by products such as tar and other gases, are collected at the outlet 454 prior to collecting the carbonaceous material by opening valve 442.

To reduce the operating times under the embodiments disclosed in FIGS. 1–6, the inert gas which is passed through the system can be preheated to a temperature approaching the optimal operational temperatures of the heat exchange medium. Desirable reductions in the overall operation time of the system have been obtained, for example, when the inert gas temperature has been preheated to approximately 50° F. below the temperature of the heated carbonaceous material.

In the event that the carbonaceous material contains an undesirably high level of sulfur, the carbonaceous material can be treated either before or after the heat exchange and upgrading step is carried out. Prior to upgrading the carbonaceous fuel, the amount of $H_2S$ that is generated during the upgrading process can be limited to a desired amount by adding fine amounts of a sorbent material such as limestone to the charge of carbonaceous material. Due to the temperature and pressure over time, the sorbent will adsorb most of the $H_2S$ generated. This process eliminates the need for additional costly equipment. The finished product can then be passed over a vibrating screen which separates the sorbent material from the upgraded carbonaceous material prior to the extrusion and pelletizing steps. Additionally, before the carbonaceous material is extruded and pelletized, fresh sorbent can be added on a mol percent basis of sulfur to calcium, such that when the carbonaceous material is burned, up to 96% of the $SO_x$ can be captured before it enters the atmosphere.

In order to further illustrate the present invention, the following specific examples are provided. It will be understood that these examples are provided as being illustrative of usable variations in the time, temperature and pressure relationships employed in the invention and are not intended to limit the scope of the invention as herein described and as set forth in the subjoining claims.

EXAMPLE 1

Wyoming subbituminous coal having an as mined moisture content of 31.0% by weight and a heating value of 7,776 BTU per pound was charged into the containment tubes of the heat exchanger of FIG. 1. The top valve was then closed off and nitrogen was introduced into the tubes containing the subbituminous coal. The pressure inside the tubes was maintained at 800 psig while the temperature of the heat exchange medium was maintained at 750° F. The temperature of the carbonaceous material contained within the tubes reached 669° F. The fuel upgrading process was carried out for 20 minutes. At the completion of the upgrading process, a valve located at the bottom of the heat exchanger was opened and the charge was removed. After the upgrading process was completed, the carbonaceous material had an increased heating value of 12,834 BTU per pound on a moisture free basis.

EXAMPLE 2

North Dakota lignite having an as mined moisture content of 37.69% by weight and a heating value of 6,784 BTU per pound was charged into the containment tubes of the heat exchanger of FIG. 1. The top valve was then closed off and nitrogen was introduced into the tubes containing the lignite. The pressure inside the tubes was maintained at 900 psig while the temperature of the heat exchange medium was maintained at 750° F. The temperature of the carbonaceous material contained within the tubes reached 656° F. The fuel upgrading process was carried out for 19 minutes. At the completion of the upgrading process, a valve located at the bottom of the heat exchanger was opened and the charge was removed. After the upgrading process was completed, the carbonaceous material had an increased heating value of 12,266 BTU per pound on a moisture free basis.

EXAMPLE 3

Canadian peat having an as mined moisture content of 67.2% by weight and a heating value of 2,854 BTU per pound was charged into the containment tubes of the heat exchanger of FIG. 1. The top valve was then closed off and nitrogen was introduced into the tubes containing the Canadian peat. The pressure inside the tubes was maintained at 1,000 psig while the temperature of the heat exchange medium was maintained at 750° F. The temperature of the carbonaceous material contained within the tubes reached 680° F. The fuel upgrading process was carried out for 20 minutes. At the completion of the upgrading process, a valve located at the bottom of the heat exchanger was opened and the charge was removed. After the upgrading process was completed, the carbonaceous material has an increased heating value of 13,535 BTU per pound on a moisture free basis.

EXAMPLE 4

Hardwood having an as mined moisture content of 70.40% by weight and a heating value of 2,421 BTU per pound was charged into the containment tubes of the heat exchanger of FIG. 1. The top valve was then closed off and nitrogen was introduced into the tubes containing the hardwood. The pressure inside the tubes was maintained at 800 psig while the temperature of the heat exchange medium was maintained at 750° F. The temperature of the carbonaceous material contained within the tubes reached 646° F. The fuel upgrading process was carried out for 7 minutes. At the completion of the upgrading process, a valve located at the bottom of the heat exchanger was opened and the charge was removed. After the upgrading process was completed, the carbonaceous material had an increased heating value of 11,414 BTU per pound on a moisture free basis.

The various embodiments of the present invention can also be utilized to transform relatively useless biomass materials into activated carbon which is useful in making high purity charcoal. For example, the biomass material is charged into the containment tubes of the heat exchanger of FIG. 1, while the tubes are continuously swept with preheated inert gas providing the system with a pressure which ranges from between 2 PSIG to about 3000 PSIG depending on the actual composition of the bio-mass. The system temperature ranges from between about 250° F. to about 1500° F. In one test, run (see Table 1 below), the containment tubes were swept with Nitrogen flowing at 10 square feet per hour (SCFH), the average temperature was maintained at approximately 750° F. and the pressure was maintained at approximately 20 PSIG.

| Time (min.) | System Temp. (°F.) | Temp. of Tubes' Outside Diameter (°F.) | Temp. of Tubes' Inside Diameter (°F.) | Pressure within Tubes (PSIG) | Pressure Outside Tubes (PSIG) | Nitrogen Flow (SCFH) |
|---|---|---|---|---|---|---|
| 0 | 756 | 749 | 770 | 0 | 0 | 0 |
| 0:01 | — | — | — | — | — | 10 |
| 1:30 | — | 740 | 227 | 21.0 | 20.5 | 10 |
| 2:00 | — | 740 | 188 | 20.1 | 19.5 | 10 |
| 3:00 | 741 | 743 | 169 | 20.0 | 19.4 | 10 |
| 4:00 | 749 | 753 | 159 | 20.1 | 19.5 | 10 |
| 5:00 | 757 | 763 | 156 | 19.9 | 19.2 | 10 |
| 6:00 | 761 | 769 | 160 | 19.9 | 19.3 | 10 |
| 7:00 | 760 | 771 | 181 | 20.1 | 19.5 | 10 |

-continued

| Time (min.) | System Temp. (°F.) | Temp. of Tubes' Outside Diameter (°F.) | Temp. of Tubes' Inside Diameter (°F.) | Pressure within Tubes (PSIG) | Pressure Outside Tubes (PSIG) | Nitrogen Flow (SCFH) |
|---|---|---|---|---|---|---|
| 8:00 | 760 | 771 | 252 | 20.1 | 19.5 | 10 |
| 9:00 | 758 | 768 | 442 | 20.0 | 19.4 | 10 |
| 10:00 | 758 | 766 | 599 | 19.9 | 19.2 | 10 |
| 11:00 | 758 | 764 | 657 | 20.1 | 19.6 | 10 |
| 12:00 | 760 | 763 | 659 | 20.1 | 19.6 | 10 |
| 13:00 | 764 | 765 | 650 | 20.1 | 19.7 | 10 |
| 14:00 | 768 | 767 | 638 | 20.3 | 19.7 | 10 |
| 15:00 | 772 | 770 | 628 | 20.3 | 20.0 | 0 |

After 15 minutes within the heat exchanger, the Nitrogen sweep was discontinued and the bio-mass was substantially dried and cooled for approximately 20 minutes. The process transformed the bio-mass material into raw activated charcoal having a heating value of 12,949 btu on a moisture free basis.

While it will be apparent that the preferred embodiments of the invention disclosed are well calculated to fulfill the objects stated, it will be appreciated that the invention is susceptible to modification, variation and change without departing from the spirit thereof.

I claim:

1. Apparatus for increasing the BTU value of solid granular carbonaceous material, comprising:

heat exchange means having an outer casing, an inlet for a charge of solid granular carbonaceous material at a first end of said outer casing and an outlet at a second end of said outer casing, said second end being spaced apart from the first end, at least one tube member contained within said casing for receiving a charge of solid granular carbonaceous material, valve means located along said first end for distributing the charge into said at least one tube member and outlet means located along said second end for removing the charge from said outlet, said at least one tube member being disposed between the inlet and outlet;

means coupled to the heat exchange means for introducing pressurized gas into said at least one tube member;

means for circulating a heat exchange medium throughout said outer casing and in contact with said at least one tube, wherein said heat exchange medium is heated to a temperature of between about 250° F. and about 1200° F.; and means for conveying the solid granular carbonaceous material extending away from said heat exchange means at the second end.

2. The apparatus of claim 1, wherein the pressure of said at least one tube member is maintained at between about 2 PSIG to about 3,000 PSIG.

3. A process of increasing the btu value of carbonaceous material comprising the steps of:

(a) providing a heat exchanger having at least one inlet tube inside an outer casing, an inlet for solid granular carbonaceous material, an inlet for pressurized gas in communication with said at least one tube, and an outlet for said solid granular carbonaceous material, and introducing solid granular carbonaceous material into said at least one tube through said solid granular carbonaceous material inlet;

(b) circulating a heat exchange medium having a temperature of at least 200° F. around said at least one tube;

(c) injecting through said pressurized gas inlet pressurized gas into the at least one tube containing carbonaceous material at a pressure of between about 2 PSIG and about 3,000 PSIG; and (d) thereafter recovering the solid granular carbonaceous material through said outlet.

4. The process as defined in claim 3, wherein the heat exchange medium is at a temperature between about 200° F. and about 1200° F.

5. A process of increasing the btu value of carbonaceous material which comprises the steps of providing a heat exchanger having at least one inlet tube inside an outer casing, an inlet for solid granular carbonaceous material, an inlet for pressurized gas in communication with said at least one tube, and an outlet for said solid granular carbonaceous material: charging solid granular carbonaceous material into said at least one tube through said solid granular carbonaceous material inlet, heating said solid granular carbonaceous material by circulating a heat exchange medium having a temperature of between about 200° F. to about 1200° F. around said at lest one tube, removing water driven from said solid granular carbonaceous material from the at least one tube, raising the temperature of the said granular carbonaceous material to a pre-determined temperature within said at least one tube, injecting through said pressurized gas inlet an inert gas having a pressure of between about 2 PSIG to about 300 PSIG into said at least one tube, and recovering the carbonaceous material through said outlet.

6. A process for increasing the btu value of carbonaceous material comprising the steps of:

(a) providing a heat exchange having at least one inlet tube inside an outer casing, an inlet for solid granular carbonaceous material, an inlet for pressurized gas in communication with said at least one tube, and an outlet for said solid granular carbonaceous material, and introducing a charge of solid granular carbonaceous material into said at least one tube through said solid granular carbonaceous material inlet, said heat exchanger having a plurality of valves spaced along one dimension of the heat exchanger;

(b) circulating a heat exchange medium having a temperature of between about 250° F. to about 1200° F. around successively longer portions of the at least one tube by successively opening and closing selected pairs of the plurality of valves;

(c) injecting through said pressurized gas inlet a pressurized inert gas in the range of from about 2 PSIG to about 3000 PSIG into said at least one tube containing the charge of B solid granular carbonaceous material; and (d) recovering the carbonaceous material through said outlet.

7. The process of claim 6, wherein the gas is carbon dioxide.

8. An apparatus for increasing the BTU value of a carbonaceous material comprising:

heat exchanger means having an outer casing, an inlet for solid granular carbonaceous material located along a first end, and an outlet spaced from said inlet and located along a second end for removing the solid granular carbonaceous material, said outer casing receiving a charge of carbonaceous material, means for introducing the charge of carbonaceous material into said casing, outlet means for removing the charge of carbonaceous material from said outlet, and at least one tube for circulating a heat exchange medium within said outer casing wherein said at least one tube isolates the solid granular carbonaceous material from said heat exchange medium, said heat exchange medium being heated to between about 200° F. and about 1200° F.;

means coupled to the heat exchange means for introducing pressurized gas into said outer casing; and means for conveying the charge of solid granular carbonaceous material away from said heat exchange means.

9. The apparatus of claim 8, wherein the operating pressure of said outer casing is maintained at between 2 PSIG to 3000 PSIG.

10. The apparatus of claim 8, wherein said heat exchange medium is an oil.

11. The apparatus of claim 8, wherein said means for circulating heat exchange medium throughout said casing comprising a plurality of vertically aligned tubes, wherein said vertically aligned tubes are in contact with the change of carbonaceous material.

12. An apparatus for upgrading carbonaceous material, comprising:

heat exchange means including an outer casing having an inlet at a first end of the outer casing and an outlet at a second end of the outer casing, said second end being spaced apart from the first end, at least one tube member contained within the outer casing for receiving a charge of solid granular carbonaceous material, means for distributing the solid granular charge into the at least one tube member and means for removing the charge from said outlet;

means for introducing pressurized gas into said at least one tube member; and means for circulating a heat exchange medium within said outer casing in contact with said at least one tube;

whereby upon circulating the heat exchange medium at an elevated temperature within said outer casing for an extended period of time the BTU value of the charge of said granular carbonaceous materials is increased.

13. The apparatus of claim 12, further comprising:

means for transporting the solid granular charge of carbonaceous material to means for storing the charge as the charge exits said heat exchange means, said means for transporting the solid granular charge extending from said outlet and said means for storing the solid granular charge extending from the means for transporting the charge.

14. The apparatus of claim 13, further comprising:

means for preparing said solid granular carbonaceous material for pelletizing, said means including an extruder extending from said means for storing the carbonaceous material.

15. The apparatus of claim 12, wherein said means for circulating heat exchange medium includes flanges extending inwardly from said outer casing, whereby said heat exchange medium is directed over said flanges within said outer casing.

16. The apparatus of claim 15, wherein said means for circulating heat exchange medium within said outer casing further comprise a plurality of dual inlet-outlet valves wherein a first valve is positioned proximate to the inlet of said outer casing, a second valve is positioned below said first valve along said outer casing and conduit means extending from said first and second inlet-outlet valves which lead to a furnace for heating the heat exchange medium.

17. The apparatus of claim 16, wherein four inlet-outlet valves spaced apart along said outer casing are provided.

18. The apparatus of claim 16, wherein said heat exchange medium which is circulated throughout said outer casing is heated to between about 250° F. and about 1200° F.

19. The apparatus of claim 12, wherein said pressurized gas comprises an inert gas.

20. The apparatus of claim 19, wherein said inert gas further comprises nitrogen.

21. The apparatus of claim 12, wherein said pressurized gas comprises carbon dioxide.

22. The apparatus of claim 12, wherein hydrogen is injected along with said pressurized gas.

23. The apparatus of claim 12, wherein the pressure of said at least one tube containing said carbonaceous material is maintained at between about 2 PSIG to about 3,000 PSIG during upgrading.

24. The apparatus of claim 12, wherein said heat exchange medium is an oil.

25. The apparatus of claim 12, wherein said heat exchange medium comprises heated gas.

26. The apparatus of claim 12, further comprising at least two input lock hoppers for storing the solid granular charge of carbonaceous material, means for transferring a charge of solid granular carbonaceous material from one of said lock hoppers to said heat exchange means, and introducing the charge of solid granular carbonaceous material into said at least one tube member while simultaneously filling another of said at least two input lock hoppers with solid granular carbonaceous material.

27. The apparatus of claim 12, wherein said means for circulating heat exchange medium within said outer casing further comprises multiple sets of interconnected tubes arranged in a series for directing said heat exchange medium oppositely through each successive set of interconnected tubes, said heat exchange medium being introduced into a first set of said interconnected tubes located at a first end of said outer casing through an inlet valve and said heat exchange medium exiting a second set of said interconnected tubes through an outlet valve located along a second end of said outer casing.

28. The apparatus of claim 27, wherein said heat exchange medium is reheated by a furnace after exiting said outlet valve and prior to being recirculated into said first set of said interconnected tubes.

29. A process for upgrading carbonaceous material comprising the steps of:

a. providing a heat exchanger having at least one inlet tube inside an outer casing, an inlet for solid granular carbonaceous material, and an inlet for pressurized gas in communication with said at least one tube.

b. introducing through said inlet for carbonaceous material a solid granular charge of carbonaceous material into said at least one tube contained within said heat exchanger, c. introducing a heat exchange medium within said outer casing of said heat exchanger, d. circulating the heat exchange medium within said outer casing of said heat exchanger around and in contact with said at least one tube, e. injecting pressurized gas through said gas inlet into said at least one tube containing the solid granular carbonaceous material; and f. recovering the solid granular carbonaceous material once the solid granular carbonaceous material has attained an upgraded BTU value.

30. The process as defined in claim 29, wherein the pressure within said at least one tube is maintained at between 2 PSIG and about 3,000 PSIG.

31. The process as defined in claim 29, wherein the heat exchange medium which is circulated around said at least one tube is heated to a temperature of between about 250° F. and about 1,200° F.

32. The process as defined in claim 31, wherein the solid granular carbonaceous material remains within said at least one tube at a desired temperature and pressure for a period of time of at least about 3 minutes.

33. The process as defined in claim 31, wherein the solid granular carbonaceous material remains within said at least one tube at a desired temperature and pressure for a period of time of under about 30 minutes.

34. The process of claim 29, wherein said heat exchange medium is an oil.

35. The process of claim 29, wherein said heat exchange medium is a heated gas.

36. A process of upgrading carbonaceous material which comprises the steps of providing a heat exchanger having at least one inlet tube inside an outer casing, an inlet for solid granular carbonaceous material, and an inlet for pressurized gas in communication with said at least one tube, charging solid granular carbonaceous material into at least one tube contained within an outer casing, injecting pressurized gas into said at least one tube, heating said solid granular carbonaceous material by circulating a heat exchange medium around and generally in direct contact with said at least one tube to upgrade the carbonaceous material, removing by heating, water contained in said carbonaceous material, raising the temperature of the carbonaceous material to a pre-determined temperature within said at least one tube, and recovering the upgraded carbonaceous material.

37. The process of claim 36 wherein the pressurized gas is introduced into said at least one tube while said heat exchange medium is being circulated until the pressure reaches a pre-determined level.

38. The process of claim 36, wherein said heat exchange medium is an oil.

39. The process of claim 36, wherein said heat exchange medium is heated gas.

40. The process of claim 37, wherein the pressurized gas which is introduced into said at least one tube is in the range of from about 2 PSIG to about 3,000 PSIG and the pre-determined temperature to which the carbonaceous material is raised is in the range of from about 250° F. to about 1,200° F.

41. The process of claim 40, wherein said solid granular carbonaceous material remains within said at least one tube in the range of from about 3 minutes up to about 30 minutes.

42. The process of claim 36, wherein the upgraded solid granular carbonaceous material is recovered via an extruder for pelletizing the upgraded carbonaceous material.

43. A process of increasing the BTU value of carbonaceous material comprising the steps of:

a) providing a heat exchanger having at least one inlet tube inside an outer casing, an inlet for solid granular carbonaceous material, an inlet for pressurized gas in communication with said at least one tube, and a plurality of valves spaced along at least one dimension of the heat exchanger and exteriorly thereof;

b) introducing through said inlet for carbonaceous material a charge of solid granular carbonaceous material into said at least one tube;

c) injecting pressurized gas into the at least one tube to facilitate heat transfer from the at least one tube to said charge of solid granular carbonaceous material;

d) circulating a heat exchange medium throughout the outer casing of said heat exchanger around successively longer portions of the at least one tube by successively opening and closing selected pairs of the plurality of valves; and e) recovering the solid granular carbonaceous material once the carbonaceous material has attained a desired BTU value.

44. The process of claim 43, wherein each portion of the at least one tube is subjected to the heat exchange medium for a time sufficient to cause moisture in a portion of the change contained within each portion to vaporize and condense on the solid granular carbonaceous material contained within succeeding portions of the at least one tube, thereby preheating the carbonaceous material contained in said succeeding portions of the at least one tube.

45. The process of claim 43, wherein the gas injected under pressure into said at least one tube is injected at a pressure in the range of from about 2 PSIG to about 3000 PSIG and the temperature at which the heat exchange medium is circulated throughout said outer casing is from about 250° F. to about 1200° F.

46. The process of claim 45, wherein the gas injected into said at least one tube is an inert gas.

47. The process of claim 45, wherein the gas injected into said at lest one tube is carbon dioxide or nitrogen.

48. The apparatus of claim 27, wherein said heat exchange means includes at least one hatch extending from said outer casing, wherein said hatch provides access to said tubes.

49. The apparatus of claim 8, wherein said heat exchange medium is heated gas.

50. A process for upgrading carbonaceous material comprising the steps of:

a. providing a heat exchanger having at least one tube inside an outer casing, an inlet for solid granular carbonaceous material, and an inlet for pressurized gas in communication with said outer casing;

b. introducing through said inlet for carbonaceous material a solid granular charge of carbonaceous material into said outer casing;

c. introducing a heat exchange medium within said at least one tube contained within said outer casing;

d. circulating the heat exchange medium within said at least one tube;

e. injecting pressurized gas through said gas inlet into said outer casing containing the solid granular carbonaceous material; and f. recovering the solid granular carbonaceous material once the solid granular carbonaceous material has attained an upgraded BTU value.

51. The process as defined in claim 50, wherein the pressure within said outer casing is maintained at between 2 PSIG and about 3,000 PSIG.

52. The process as defined in claim 50, wherein the heat exchange medium which is circulated within said at least one tube is heated to a temperature of between about 250° F. and about 1,200° F.

53. The process as defined in claim 52, wherein the solid granular carbonaceous material remains within said outer casing at a desired temperature and pressure for a period of time of at least about 3 minutes.

54. The process as defined in claim 52, wherein the solid granular carbonaceous material remains within said outer casing at a desired temperature and pressure for a period of time of under about 30 minutes.

55. The process of claim 50, wherein said heat exchange medium is an oil.

56. The process of claim 50, wherein said heat exchange medium is a heated gas.

* * * * *

UNITED STATES PATENT AND TRADEMARK OFFICE

CERTIFICATE OF CORRECTION

PATENT NO. : 5,290,523

DATED : March 1, 1994

INVENTOR(S) : Edward Koppelman

It is certified that error appears in the above-indentified patent and that said Letters Patent is hereby corrected as shown below:

Column 12, Line 35, Claim 5, "lest" should be --least--.

Column 12, Line 65, Claim 6, after "of" delete "B".

Column 13, Line 5, Claim 8, "exchanger" should be --exchange--.

Column 13, Line 56, Claim 12, "said" should be --solid--.

Column 13, Line 56, Claim 12, "materials" should be --material--.

Column 13, Line 35, Claim 11, "Change" should be --charge--.

Signed and Sealed this

Thirtieth Day of August, 1994

*Attest:*

*Attesting Officer*

Bruce Lehman

BRUCE LEHMAN

*Commissioner of Patents and Trademarks*